US006000089A

United States Patent [19]

Renken

[11] Patent Number: 6,000,089

[45] Date of Patent: Dec. 14, 1999

[54] SQUEEGEE HAVING SPONGE WASHER WITH REPLACEABLE MESH PROTECTOR APPARATUS

[76] Inventor: John C. Renken, 6815 Washington St. NE., Fridley, Minn. 55432

[21] Appl. No.: 09/042,299

[22] Filed: Mar. 13, 1998

[51] Int. Cl.[6] ..... A47L 1/15

[52] U.S. Cl. ..... 15/121; 15/118; 15/220.1; 15/244.3

[58] Field of Search ..... 15/118, 121, 210.1, 15/231, 232, 233, 244.1, 244.3, 245, 220.1

[56] References Cited

U.S. PATENT DOCUMENTS

| | | | |
|---|---|---|---|
| 1,644,642 | 10/1927 | Horihata | 15/231 |
| 1,847,046 | 2/1932 | Guerra | 15/231 |
| 2,601,537 | 6/1952 | Lofgren | 15/231 |
| 3,641,612 | 2/1972 | Clurman et al. | 15/231 |
| 3,724,017 | 4/1973 | Mallory | 15/121 |
| 3,783,469 | 1/1974 | Siemund | 15/121 |
| 4,106,153 | 8/1978 | Lemelson | 15/231 |
| 4,550,467 | 11/1985 | Johnson et al. | 15/233 |
| 5,448,793 | 9/1995 | Mallory et al. | 15/232 |

*Primary Examiner*—Mark Spisich
*Assistant Examiner*—Theresa T. Snider
*Attorney, Agent, or Firm*—Nawrocki, Rooney & Sivertson, P.A.

[57] ABSTRACT

The squeegee has a sponge washer which is attached to a support and covered by a mesh protector. Replacement apparatus provides for rapid replacement of the mesh. The replacement apparatus includes a length of mesh wrapped around a reel. The wrapped end of the mesh is secured by locking the reel against rotation, and the free end of the mesh is secured by a plastic strip with a serrated edge which engages the mesh. The strip is wedged within a recess in the support. To replace mesh which extends over the washer, the free and wrapped ends are released, a length of mesh is pulled from the reel and stretched over the washer. Both ends of the mesh are then resecured. The reel is removable to permit providing a new mesh supply. A cellulose cleaning disk for cleaning insects and similar difficult spots can be removably attached at one end of the washer.

5 Claims, 4 Drawing Sheets

SQUEEGEE HAVING SPONGE WASHER WITH REPLACEABLE MESH PROTECTOR APPARATUS

BACKGROUND OF THE INVENTION

1. Field of the Invention

This invention relates to improved window cleaning apparatus, in particular to a squeegee which includes a mechanism to readily replace mesh used to protect a sponge washer.

2. Description of the Prior Art

A number of squeegee type window cleaners are known in the art. Typically these squeegees have a handle attached to a support with a sponge washer attached to one side of the support. This arrangement permits using the handle readily to manipulate the sponge washer and remove dirt and insects from a window. Most squeegees also provide a wiper element opposite the sponge washer to facilitate removing water from a window. The wiper element is also manipulated by the handle. A squeegee type window cleaning apparatus which also uses mesh to protect a foam washing element is disclosed in Mallory, U.S. Pat. No. 5,448,793. Mallory describes and teaches the use of a washer protected by a mesh screen.

No apparatus known in the art, of which applicant is aware, provides means for readily replacing all of the working parts in a squeegee which become worn in normal usage. As a consequence squeegee replacement is abnormally high because a squeegee must be replaced when only one of the working parts is damaged or worn.

SUMMARY OF THE INVENTION

Gasoline service stations usually provide a number of squeegees for customers to wash their vehicle's dirty windows. A squeegee typically has a support with a sponge washing element mounted on one side, a rubber flexible wiper mounted on the opposite side and a handle typically positioned at 90° to both. The handle extends from the support for manipulation. The sponge washer is usually covered with non-replaceable mesh to provide protection and extend the washer life. Since a squeegee is used by a great number of people, the mesh protector soon becomes torn and, with no protection, the washer can then become quickly damaged beyond use. Such squeegees do not have means for readily replacing the wearing parts, particularly the mesh and washer. This usually results in the entire squeegee being discarded when any single part is excessively worn. Because of the great number of service stations providing squeegees, cost of replacing them is high because of the great number used and discarded over time.

The instant invention provides improvements to a squeegee which makes parts readily replaceable. Since the mesh is usually worn first, the present invention provides apparatus for enabling rapid and ready replacement of the mesh covering the washer. This is accomplished by providing a spooled length of mesh which is adequate to replace the mesh covering the washer a number of times. This length of mesh is wound on a reel with extending hubs. The hubs extend into holes in flexible supporting extensions depending from the support body, and mount the reel for rotation. The extensions are located such as to position the reel near the handle and proximate the washer with the mesh oriented parallel to the surface of the extending washer surface. This permits mesh to be pulled from the reel around and over the exposed washer surface to the support surface opposite the handle. A removable locking pin, which extends through holes in the reel and opposed aligned holes around the circumference of the enclosing extension, locks the reel against rotation. This anchors the wrapped end of the mesh. The extensions are flexible enough to permit an end of the reel to be pulled free in order to permit replacing an empty mesh reel with a new reel wound with a new supply of mesh.

After pulling the mesh over the washer from the reel, the opposite free end of the mesh is stretched tight over the washer and then secured in place. The locking means for the free end of the mesh employs a recess in a surface of the support. The locking means also uses a plastic locking strip which has a serrated edge along its length. The mesh is stretched across the recess, and the serrated edge of the locking strip is placed perpendicular to the mesh with the serrated edge extending through the mesh. The mesh and locking strip are then forced into the recess. This arrangement secures the free end of the mesh in place with the mesh stretched tightly around the washer.

This process is repeated until all of the mesh on a reel has been used. The locking pin can then be removed from the reel, the free end of the mesh released, and the reel removed by springing at least one of the extensions outward. A new reel with a new length of mesh is then put into place, and the mesh is reattached over the washer as described above.

All parts of the squeegee are similarly configured for ready replacement. In addition to the usual squeegee parts a cleaner disk can be attached near one end of the washer by use of a bolt through a hole in the disk center and into a mating threaded hole in the support. This cleaner disk can be used to remove insects or similar material.

DESCRIPTION OF THE DRAWINGS

Objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE INVENTION

Figure 1:
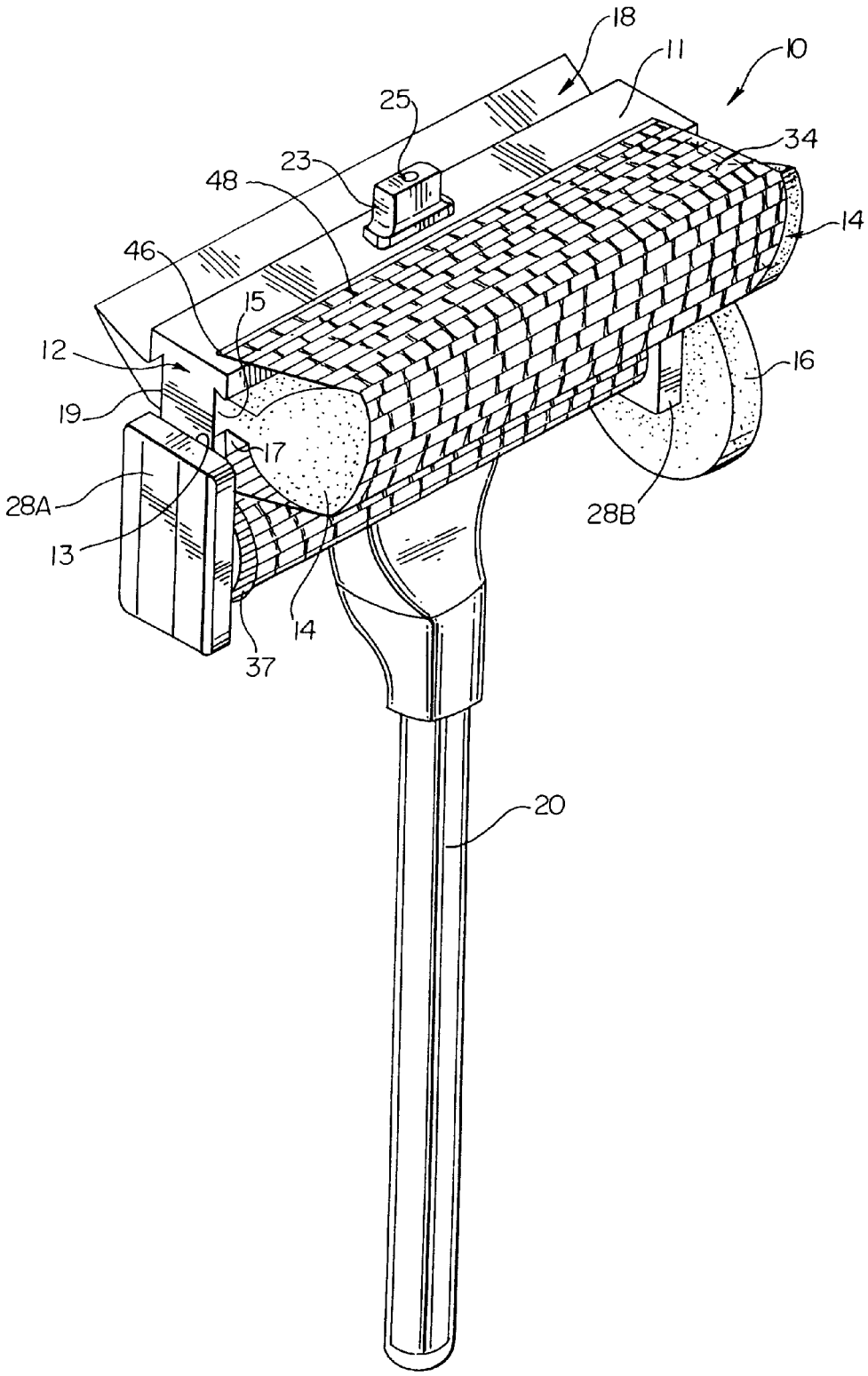
FIG. 1 is a perspective view of a squeegee in accordance with the present invention.
Figure 2:
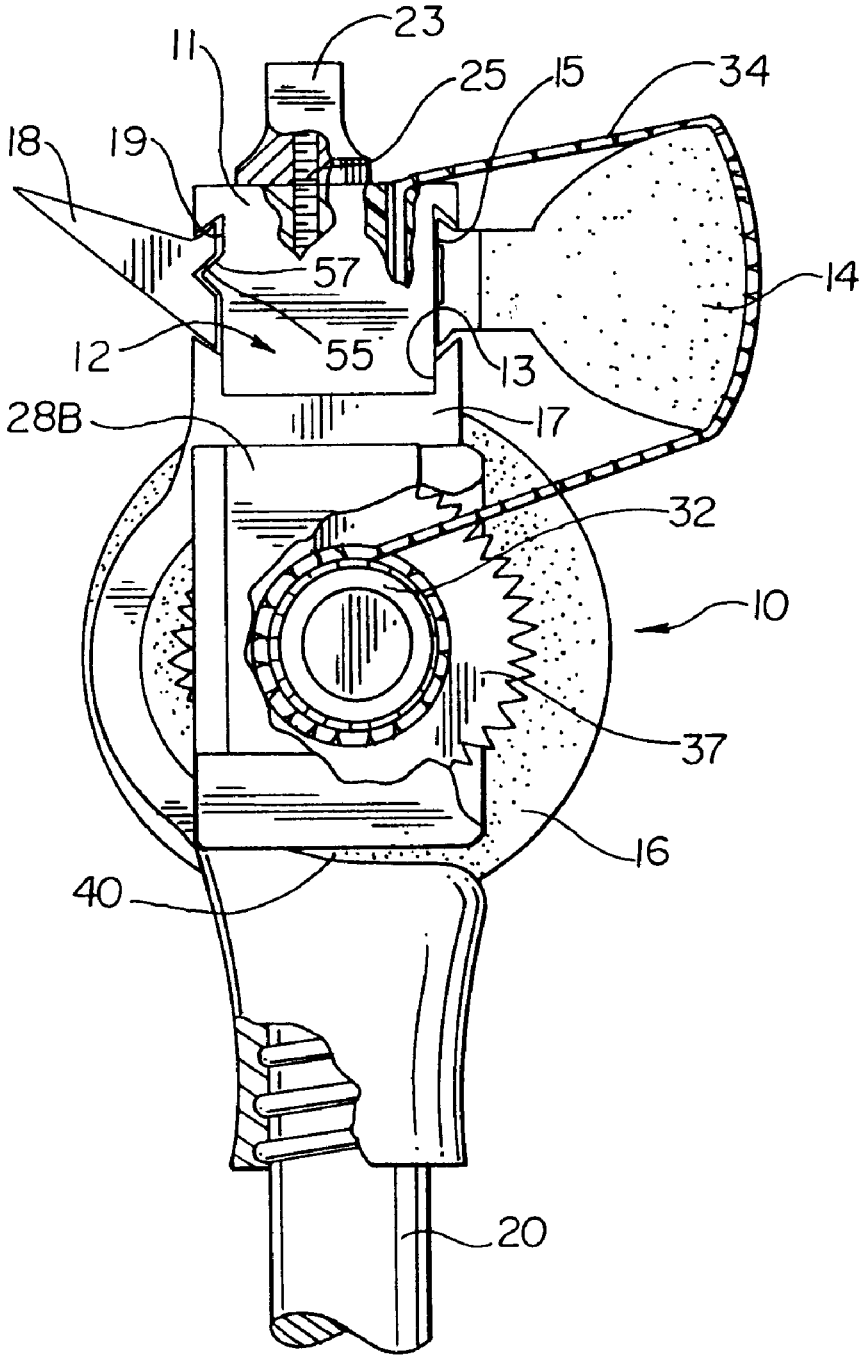
FIG. 2 is an end view of the squeegee.
Figure 3:
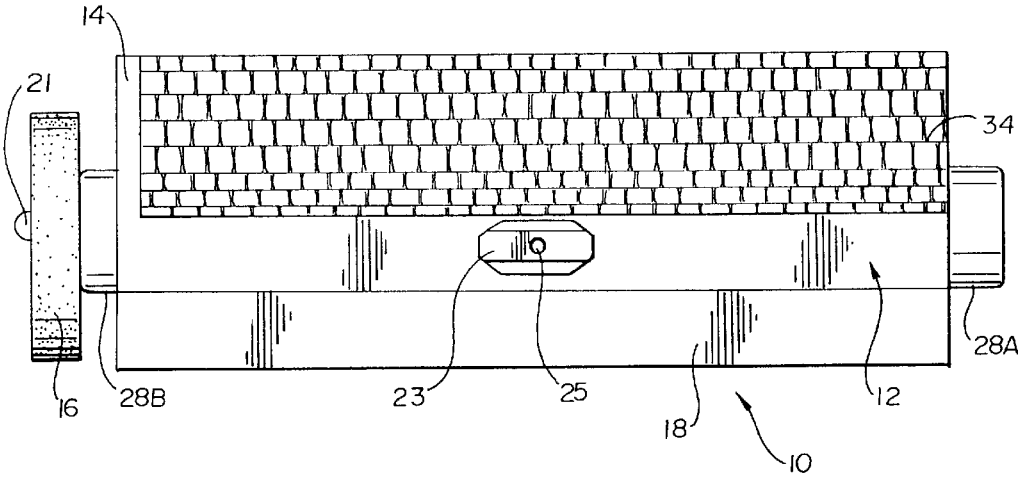
FIG. 3 is a top plan view of the squeegee.

FIGS. 1, 2, 3 and 4 show a squeegee 10 having support 12, sponge washer 14, cleaner disk 16 (which can be made of cellulose or other appropriate material), flexible wiper 18 and handle 20. Washer 14 and wiper 18 are each secured within respective opposed recesses 15 and 19 defined in support 12 by mating a carrier portion 11 into a recess 13 formed in a base portion 17. This permits replacing washer 14 and/or wiper 18 by loosening a locking nut 23 and merely sliding the washer 14 and/or wiper 18 laterally from their respective recesses 15 and 19 defined in support 12 until they are free of the support 12. FIG. 2 illustrates a wiper 18 having a keyway 55 formed in an edge thereof which engages a side face of carrier portion 11 of support 12. That face of carrier portion 11, in turn, can be provided with a key 57 positioned at a location on the face of the carrier portion 11 so that, when the key 57 is received within keyway 55, wiper 18 will be positioned at an appropriate location so that, as nut 23 is tightened down, wiper 18 will be captured within recess 19 defined in support 12 by mating carrier portion 11 with base portion 17. It will be understood that, while a similar configuration is not illustrated in the figures with respect to washer 14, in appropriate circumstances where a base of the washer 14 might be rigid, a similar key/keyway arrangement might be utilized.

Cleaner disk 16 is shown as being mounted to one of a pair of support extensions 28A, 28B, and it has a centered hole sized to receive bolt 21 which mates with a threaded hole in an extension 28B. Bolt 21 secures the cleaner disk 16 in place yet enables ready removal.

Reel 32 has axially extending hubs 36 which are rotatably journaled within mating holes in extensions 28A and 28B depending from support 12. Reel 32 has a rotation disk 37 attached at one end for simultaneous rotation. Reel 32 is rigidly secured to disk 37 and to hubs 36, and rotation of disk 37 translates into rotation of reel 32.

One end of a length of mesh 34 is wrapped around reel 32 and the opposite end is secured, after passing over washer 14, to support 12 by a plastic locking strip 48, the operation of which will be described later. The axis of reel 32 is parallel to the outer surface of washer 14. This permits mesh 34 to be pulled from the reel 32 and around and over the outer surface of the washer 14 to a recess 46, which would typically be tapered, formed in carrier portion 11 of support 12. Base portion 17 of support 12 is partially concave to allow for rotation of reel 32.

Figure 4:
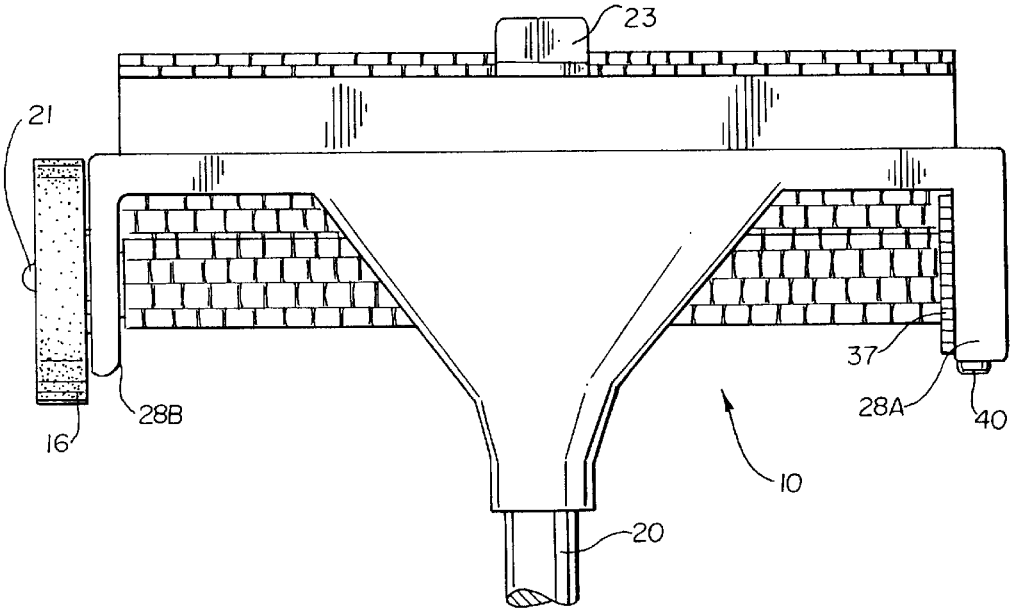
FIG. 4 is a side view of the squeegee from the side opposite the washer.
Figure 4A:
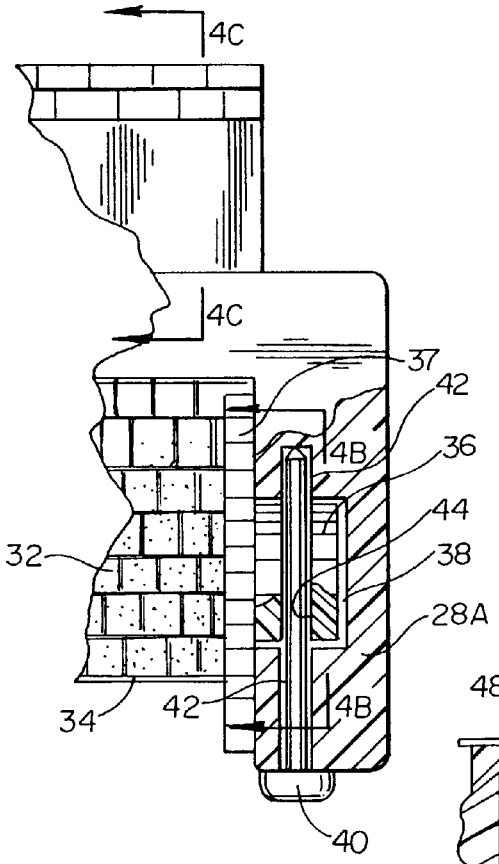
FIG. 4A is the end portion of FIG. 4 with a portion of the support extension removed to show the mesh reel hub, locking pin and the locking pin access holes.
Figure 4C:
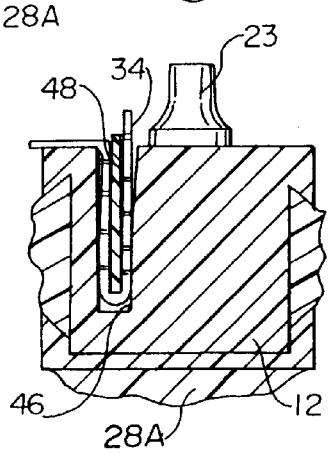
FIG. 4C is a cross-section of 4C—4C of FIG. 4A showing the serrated mesh locking strip and its interaction with the support.
Figure 4B:
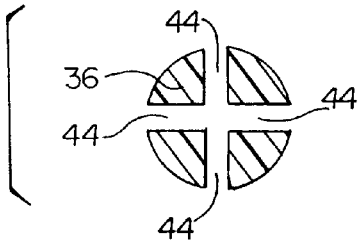
FIG. 4B is a cross-section of 4B—4B of FIG. 4A showing the pin access holes through the hub.

FIGS. 4A and 4B show details of locking means for reel 32. One hub 36 is received within a corresponding mating hole 38 in extension 28A which rotatably supports the hub 36. The opposite end of reel 32 has a hub which is received within a corresponding mating hole in extension 28B which rotatably supports the opposite end of the reel. The hubs 36 and respective extensions 28A and 28B are symmetrical except that extension 28B and its hub have no locking access holes as described below relative to extension 28A.

Extensions 28A and 28B are both flexible and extend outwardly from support 12 and generally parallel to one another. This permits flexing extensions 28A and 28B outwardly to clear hubs 36 to free the reel from capture in a position between extensions 28A, 28B. This allows replacement of the reel 32 to replenish the mesh supply.

The means for securing the mesh 34 tautly over washer 14 with one end of mesh 34 wrapped around reel 32 is shown in detail in FIGS. 4A and 4B. Aligned access holes 42 through extension 28A on diametrically opposite sides of hub 36 are sized to slideably receive locking pin 40. Pin 40 has a cap on its outermost end larger than access holes 42. Perpendicular locking holes 44 through hub 36, which are approximately the same size as access holes 42, are positioned so as to enable registration with access holes 42 when reel 32 is rotated 90°. This permits extending locking pin 40 through the outer access hole 42, through an aligned locking hole 44 in hub 36 and into the inner aligned access hole 42 to lock reel 32 against rotation. To unlock reel 32, locking pin 40 is merely withdrawn from holes 42 and 44.

Figure 5:
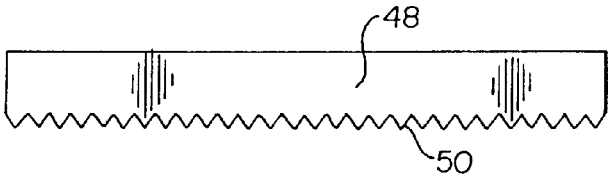
FIG. 5 is a view of the serrated mesh locking strip.

The means for securing the end of mesh 34 remote from reel 32 is shown in detail in FIGS. 4C and 5. Plastic mesh locking strip 48 is sized to fit snugly within recess 46 extending across support 12. Recess 46 can be tapered for this purpose. The plastic strip 48 has a serrated edge 50, strip 48 being inserted into recess 46 with the serrated edge 50 extending downward such that points of the serrated edge 50 engage mesh 34 to secure the free end of the mesh in place. Plastic strip 48 holds the free end of mesh 34 securely in place but can provide a quick release by merely pulling on the mesh 34 to remove the strip 48 from recess 46.

Bolt 25 has its distal, threaded end (not shown) securely captured within an aperture in support portion 17 with the threaded end of the bolt extending through and outwardly from a mating hole generally centered on the support 12. Nut 23 functions to tightly secure carrier portion 11 to portion 17. This serves to well-define recesses 15 and 19 and to reinforce the support 12.

Making all parts of the squeegee subject to wear readily replaceable in the manner described in the present invention greatly reduces the cost of use. Rather than replacing the entire squeegee when a worn mesh results in a worn washer or when other parts become worn, with the present invention only the part which is worn need be replaced. Since all parts are easily replaceable, the replacement process itself is cost effective. Because squeegees are used by a public indifferent to their destruction, a great number of squeegees are quickly damaged and presently must be replaced. The present invention permitting a quick and easy replacement of only the worn part. This results in a considerable cost savings to the operator. These improvements essentially extend the squeegee life.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. A window cleaner, comprising:

a support having two sides with a washer secured on one side and a handle extending outwardly from the support;

a predetermined length of mesh having a width generally equal to a length of the washer;

reel means for wrapping one end of the length of mesh thereabout;

a pair of extensions extending from the support to bracket said reel means therebetween and rotatably support said reel means adjacent said washer with a rotation axis of said reel means generally parallel to an elongation of said washer, said extensions being flexible such that they can be flexed outwardly to release said reel means;

means for locking said reel means against rotation relative to said extensions;

means for securing a free end of the length of mesh extending from said reel means around said washer at the support; and a cellulose cleaner for removing difficult-to-remove adherents from a window, and including means for attaching said cleaner to one of said extensions.

2. The window cleaner of claim 1 wherein:

said reel means comprises a reel with axially extending hubs along the rotational axis thereof;

said extensions have support holes spaced and sized to rotatably support the hubs of said reel therewithin; and said means for locking said reel means comprises a pin associated with one extension which has aligned first access holes, a related hub having a second access hole therethrough generally the same size as the first access holes, both first and second access holes being sized to receive said pin, said access holes being positioned and arranged such that, when the reel is between said extensions with the hubs positioned within support holes in said extensions, said pin can be inserted through the first holes and the second holes to secure the hub and reel against rotation with respect to said extensions.

3. The window cleaner of claim 2 wherein said means for securing said free end of said length of mesh comprises:

a recess formed in said support and having a length extending across said support opposite said reel means; and a strip having a serrated edge and being configured such that it can be wedged within said recess.

4. The window cleaner of claim 3 having means for securing said washer to said support.

5. The window cleaner of claim 4 having means for securing a wiper to said support opposite said washer.

* * * * *